US005351967A

United States Patent [19]

Yang

[11] Patent Number: 5,351,967

[45] Date of Patent: Oct. 4, 1994

[54] AERIAL AMUSEMENT SYSTEM WITH VACUUM MOUNTS

[76] Inventor: Tsung-Pin Yang, No. 12, Alley 2, Lane 131, Chang-Chin Rd., Hsi-Jyy, Taipei Hsien, Taiwan

[21] Appl. No.: 106,578

[22] Filed: Aug. 16, 1993

[51] Int. Cl.[5] ..... A63B 63/00; A63B 71/00; A63H 27/00

[52] U.S. Cl. ..... 273/344; 273/143 E; 273/142 R; 446/46; 446/177

[58] Field of Search ..... 446/34, 46–48, 446/177, 236, 243, 244; 273/344–347, 424, 425, DIG. 25, DIG. 26, 138 R, 139, 142 R, 143 R, 143 E

[56] References Cited

U.S. PATENT DOCUMENTS

| | | | |
|---|---|---|---|
| 1,370,682 | 3/1921 | Buys | 273/142 R |
| 1,510,574 | 10/1924 | Wrinkle | 273/139 |
| 2,068,306 | 1/1937 | Weinberg | 273/344 |
| 2,182,517 | 12/1939 | Compton | 273/DIG. 25 |
| 2,996,300 | 8/1961 | Schaper | 446/236 |
| 5,102,138 | 4/1992 | Johnson | 273/DIG. 25 |

*Primary Examiner*—Robert A. Hafer
*Assistant Examiner*—Jeffrey D. Carlson
*Attorney, Agent, or Firm*—Morton J. Rosenberg; David I. Klein

[57] ABSTRACT

A flying toy consisted of rotary disk having vacuum mounts, a base shaped like a flying saucer type and revolvably mounted on the rotary disk, a top cover covered on the base, a score board supported on a swivel bar and received in between the base and the top cover, whereby throwing the flying toy into the air toward the smooth surface of an upstanding object causes the vacuum mounts to stick to the smooth surface, and the score board is carried by the swivel bar to rotate on its center axis and then stopped to show either of a series of numbers or patterns through a convex lens on the top cover.

3 Claims, 6 Drawing Sheets

AERIAL AMUSEMENT SYSTEM WITH VACUUM MOUNTS

BACKGROUND OF THE INVENTION

The present invention relates to an aerial toy saucer or flying toy having vacuum mounts secured to a bottom wall that adhere to a smooth surface against which the flying toy is thrown.

Various aerial toys of the flying saucer type have been disclosed and are commercially available. Such prior art aerial toys are played with by throwing them through the air to provide various effects. Two or more people may play with such an aerial toy of the flying saucer type by passing it to one another. These prior art aerial toys of the flying saucer type are simply constructed and are limited in their operative functions.

SUMMARY OF THE INVENTION

The flying toy disclosed by the subject invention system is designed to randomly display either a series of numbers or patterns as it is thrown toward a smooth surface of an upstanding object. Vacuum mounts are provided on the bottom wall of the flying toy. A plurality of radial projections which gradually narrow in width as they extend outward and terminate in a bead-like tip are formed in the base of the flying toy, As the radial projections on one side of the base impinge on the smooth surface of an upstanding object, the unbalanced obstruction causes the plane of the base to responsively rotate so that the vacuum mounts are caused to stick or adhere to the smooth surface.

DETAILED DESCRIPTION OF THE PREFERRED EMBODIMENT

Figure 1:
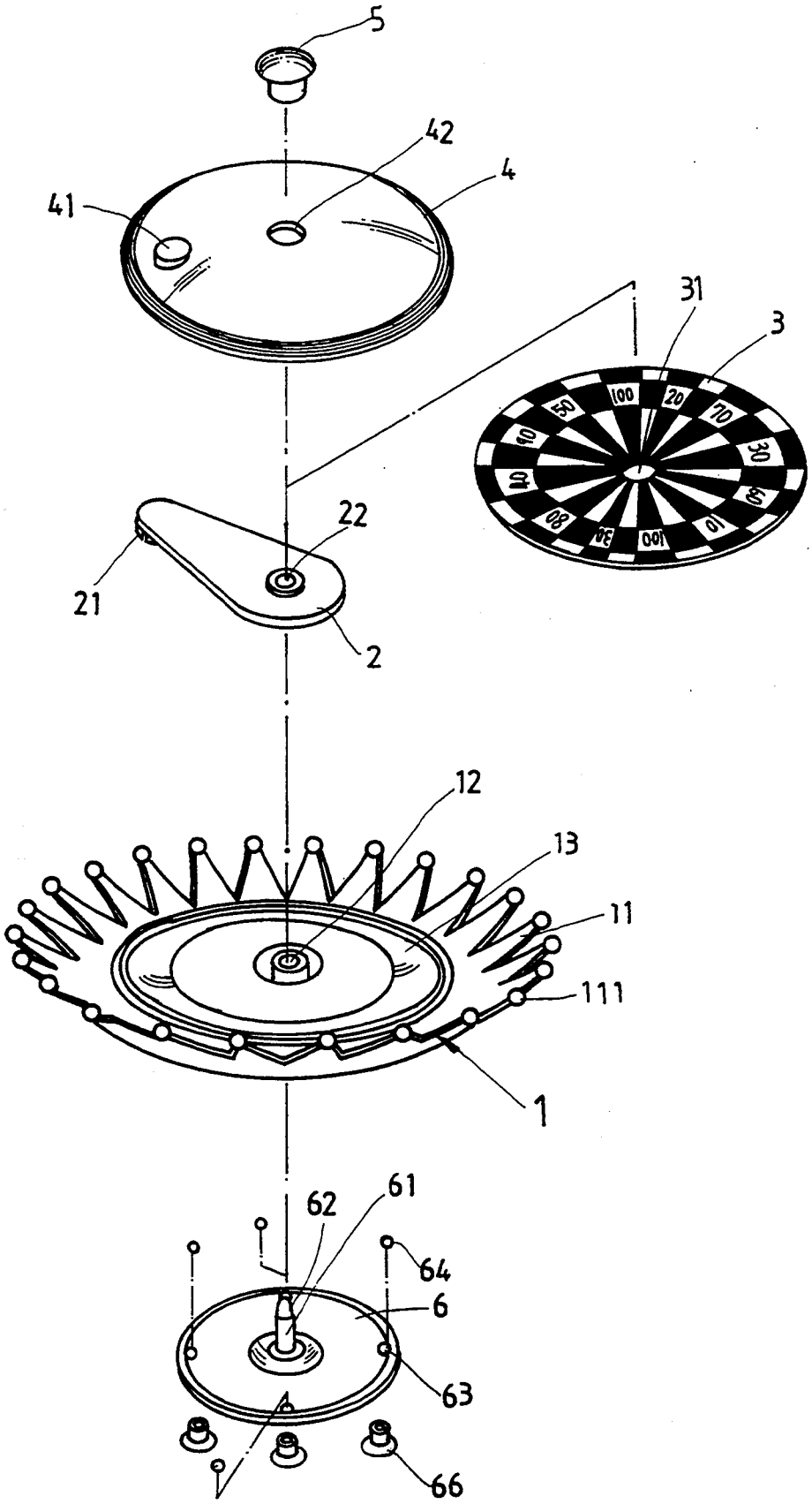
FIG. 1 is a perspective exploded view of a flying toy according to one embodiment of the present invention.
Figure 2:
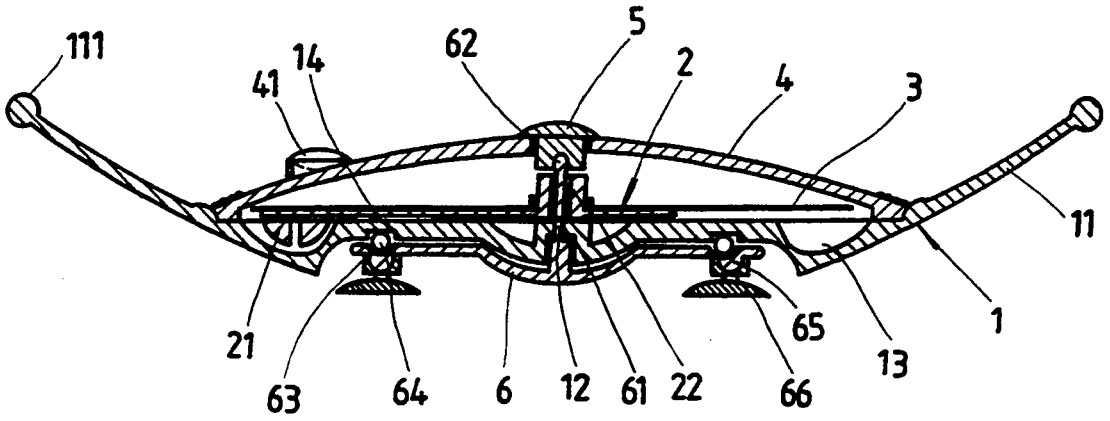
FIG. 2 is a sectional assembly view of the flying toy shown in FIG. 1.

Referring to FIGS. 1 and 2, there is shown a flying toy in accordance with the present invention generally comprising a base 1, a rotary disk 6, a swivel bar 2, a scoreboard 3, and a top cover 4. The base 1 is integrally shape molded from a resilient material. Base 1 incorporates bottom annular groove 14 formed within a bottom surface. Base 1 further incorporates top annular groove 13 formed within a top surface, an axle hole 12 passing centrally therethrough, and a plurality of projections 11 radially and obliquely extending outward and upward from base 1. The width of each projection 11 gradually narrows toward the end, terminating in a bead 111. The swivel bar 2 has an axle hole 22 formed through one end thereof and a counterweight 21 mounted on an opposite end thereof. The scoreboard 3 is printed with numbers or patterns and has a center through hole 31. The top cover 4 has formed therethrough a center through hole 42 and includes a convex lens 41 located near the boundary. The rotary disk 6 holds a plurality of steel balls 64 or bearings, each respectively received within equally-spaced recessed holes 63 formed within a top surface around the boundary. The rotary disk 6 additionally holds a plurality of vacuum mounts 66 respectively spaced to equally-spaced bottom pins 65 formed on a bottom surface around the boundary. Rotary disk 6 has formed thereon a center upright rod 61 which terminates in a connecting end 62.

The rotary disk 6, the base 1, the swivel bar 2, the scoreboard 3, and the top cover 4 are assembled together by inserting the center upright rod 61 of the rotary disk 6 through the axle hole 12 on base 1, the axle hole 22 on the swivel bar 2, the center through hole 31 on the scoreboard 3, and the center through hole 42 on the top cover 4. Fastening element 5 is fastened to the connecting end 62 of the center upright rod 61. When assembled, the counterweight 21 of the swivel bar 2 is disposed in the top annular groove 13, and the steel balls 64 are retained between the bottom annular groove 14 and respective recessed holes 63.

Figure 3:
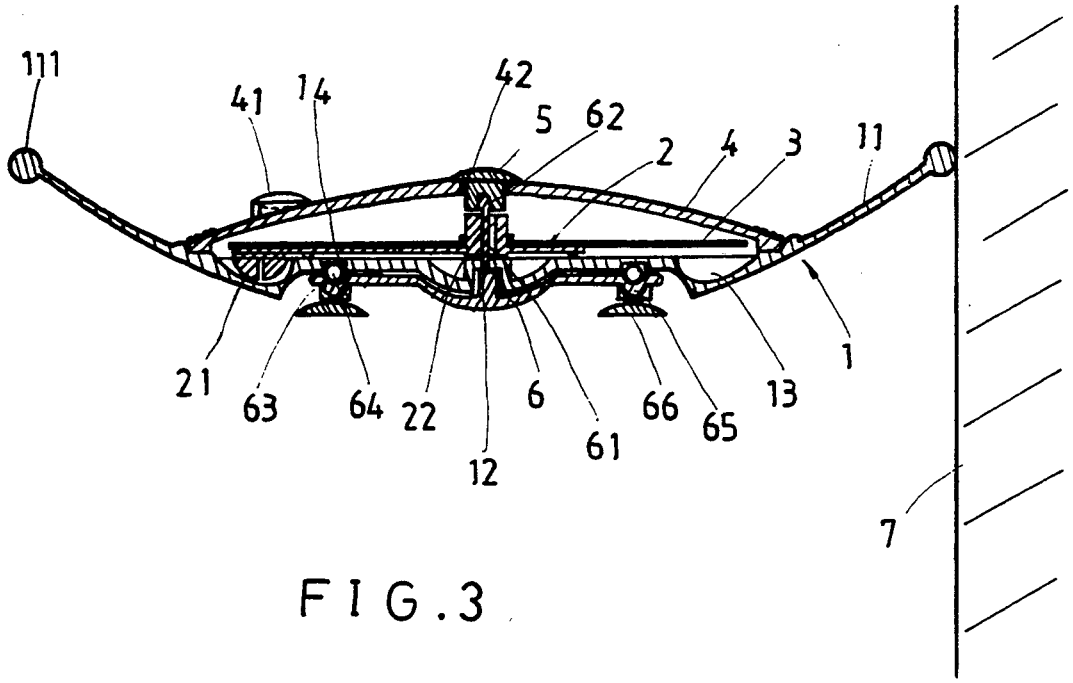
FIG. 3 is a cross-sectional view of the flying toy at the time of impingement on a wall surface.
Figure 3A:
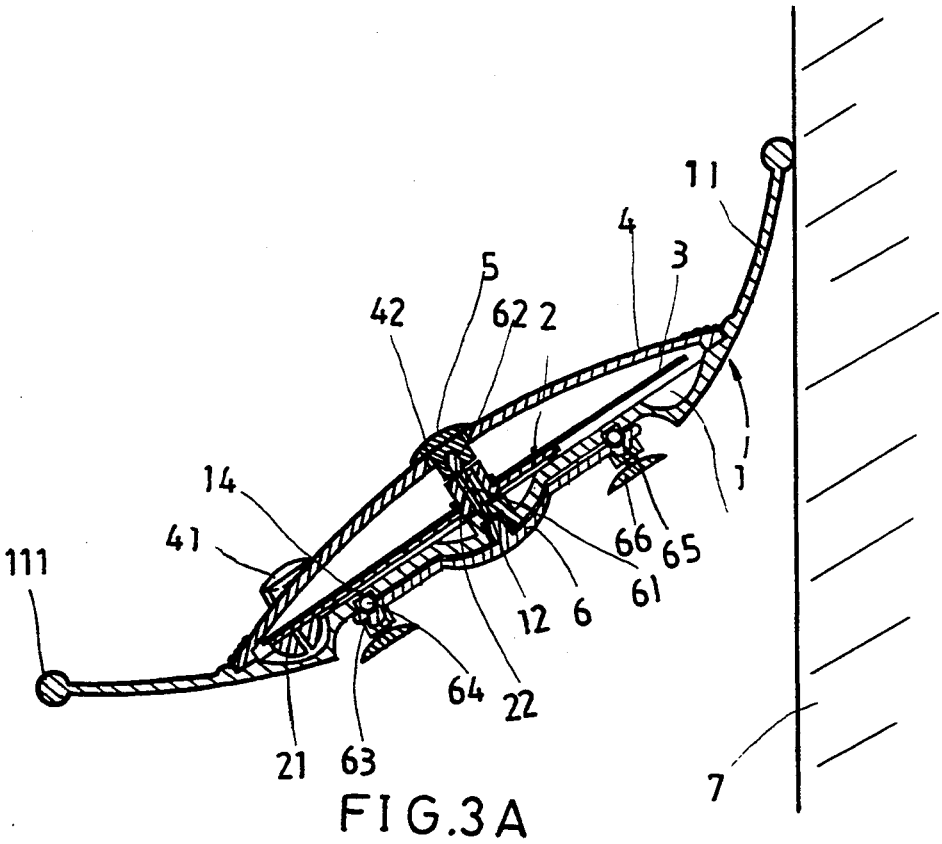
FIG. 3A is a cross-sectional view of the flying toy subsequent to initial impingement.
Figure 3B:
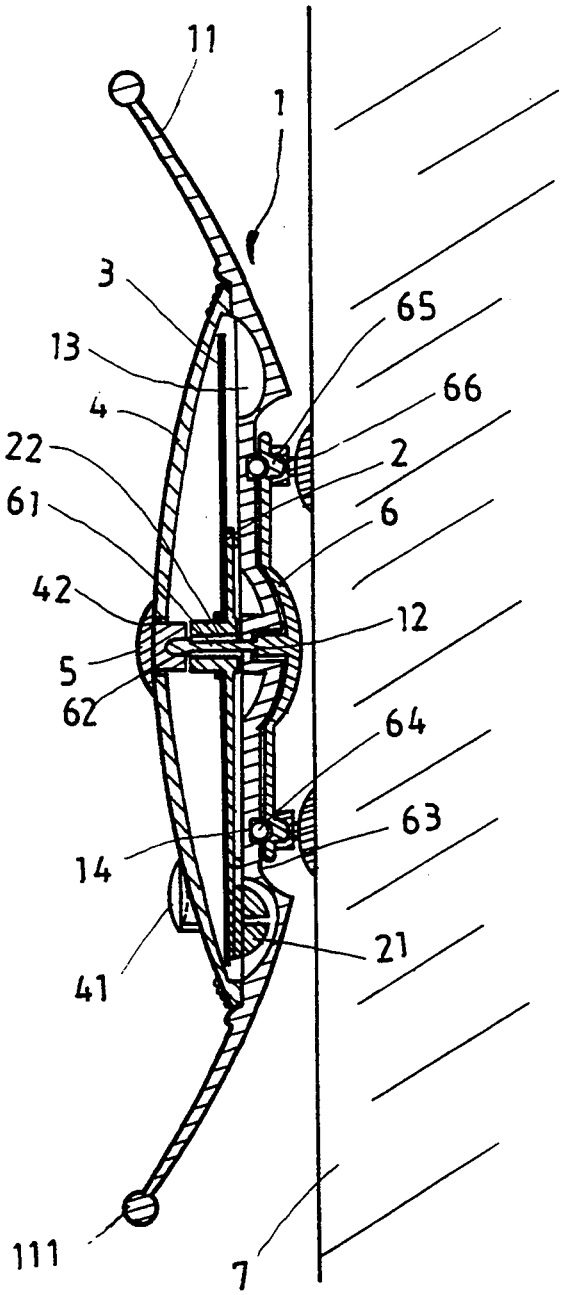
FIG. 3B is a cross-sectional view of the flying toy adhered to the wall surface.

Referring to FIGS. 3, 3A, and 3B, as the flying toy is thrown toward the smooth surface of an upstanding wall or object 7, the projections 11 will contact the upstanding object 7 first, causing the radial plane of the flying toy to rotate such that the vacuum mounts 66 are forced to adhere or stick to the smooth surface of the upstanding object 7. As the flying toy sticks on the smooth surface of the upstanding object 7, inertial force causes the base 1 to rotate on the center upright rod 61. Similarly, the scoreboard 3 and the swivel bar 2 to which it is press-fitted are together caused to rotate on the center upright rod 61, independent of the rotation of base 1. As the base 1 stops rotating, the swivel bar 2 gradually comes to rest in a vertical position by action of the counterweight 21. The player can then see a specific number or pattern of the scoreboard 3 through the convex lens 41 for providing a score.

Figure 5:
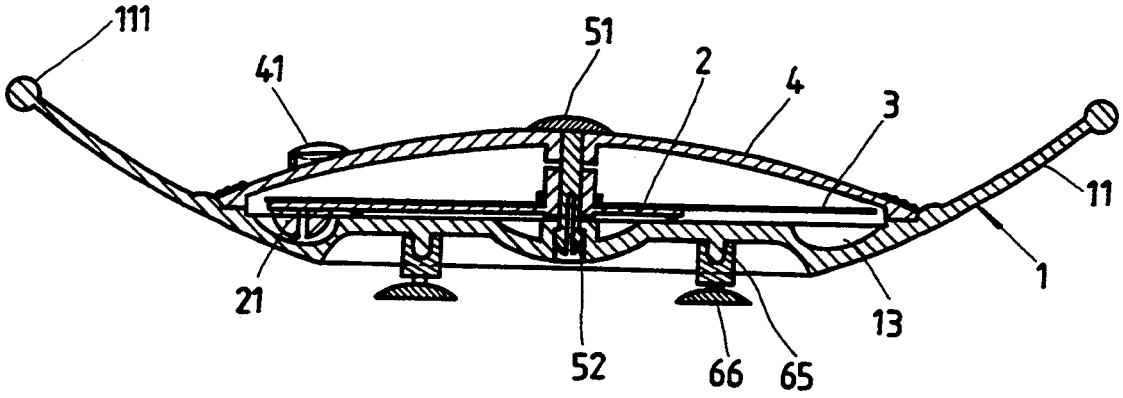
FIG. 5 is a cross-sectional view of the embodiment shown in FIG. 4; and, FIG. 6 is a bottom plan view of the embodiment of the flying toy shown in FIG. 4.
Figure 4:
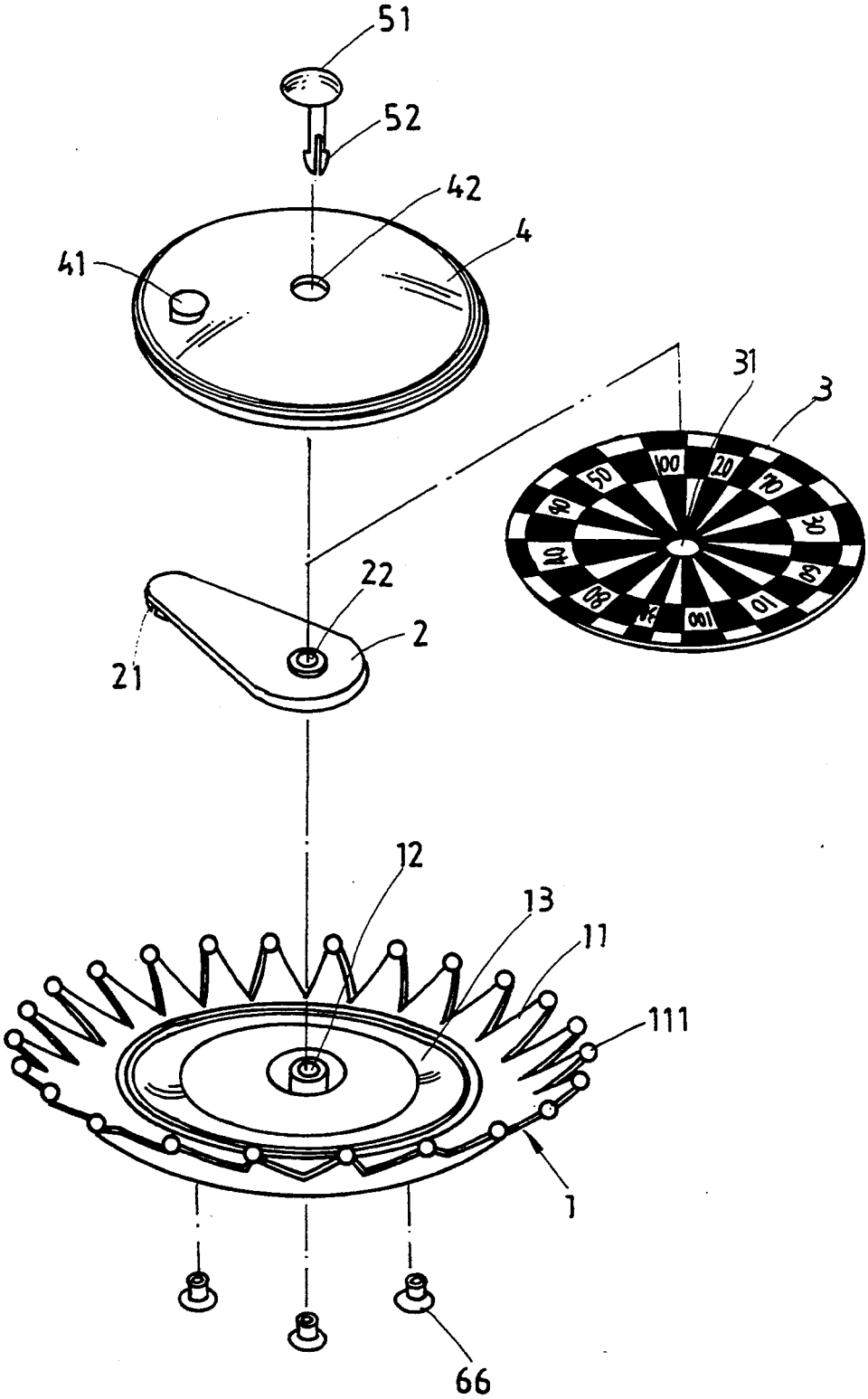
FIG. 4 is a perspective exploded view of an embodiment of the flying toy.
Figure 6:
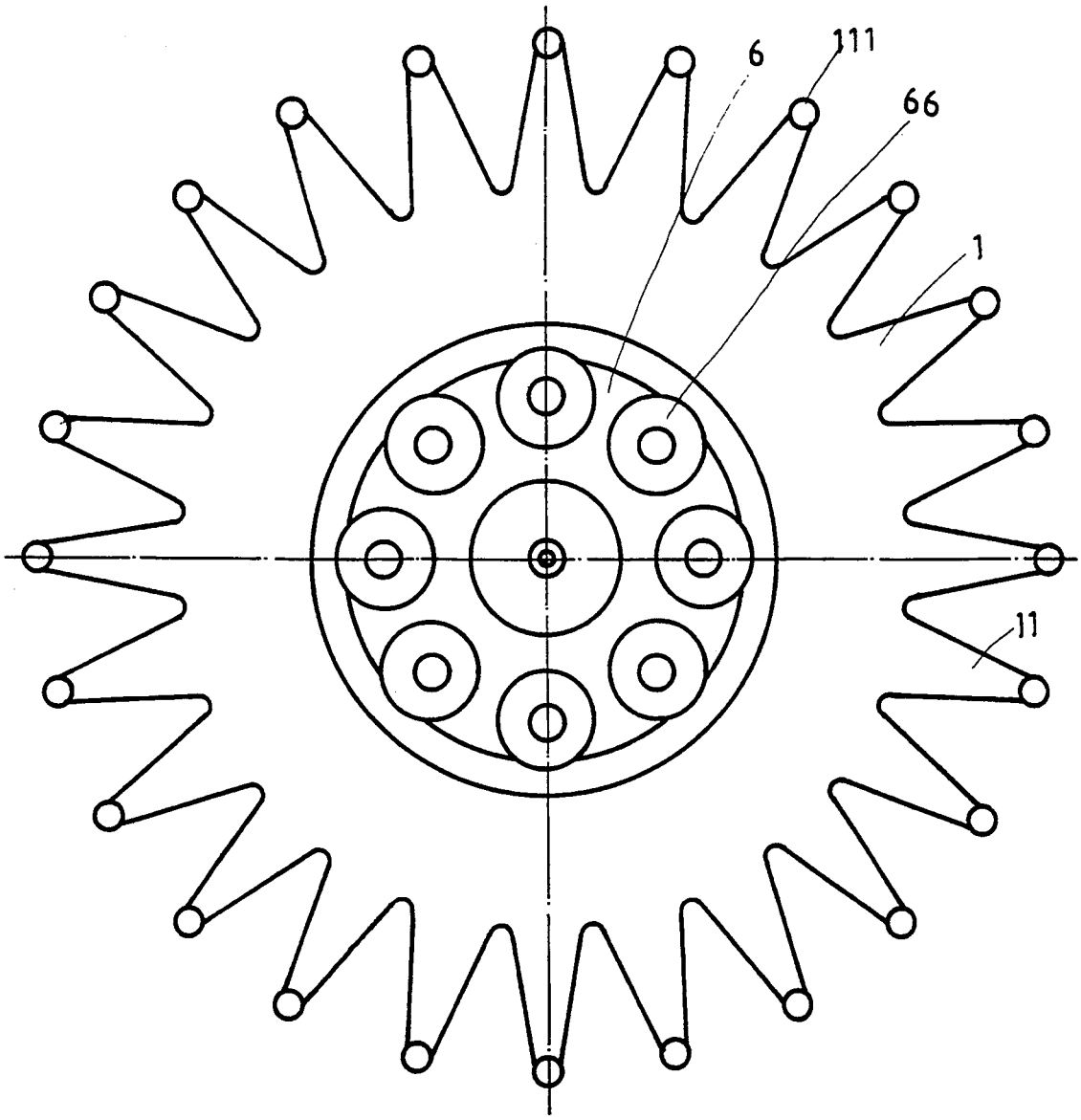

Referring to FIGS. 4 and 5, an embodiment of the present invention is illustrated, wherein like numbers indicate like parts. This embodiment eliminates the rotary disk 6. It comprises a base 1, a swivel bar 2, a scoreboard 3, a top cover 4, and a fastening element 51. The base 1 holds a plurality of vacuum mounts 66 respectively mated to equally-spaced bottom pins 65 formed on its bottom surface around its outer boundary. The fastening element 51 has formed on its end a split bolt 52 which is inserted through the center through hole 42 on the top cover 4, the center through hole 31 on the scoreboard 3, the axle hole 22 on the swivel bar 2, and the axle hole 12 on the base 1, to fasten all members together.

While only a few embodiments of the present invention have been shown and described, it will be understood that various modifications and changes could be made without departing from the spirit and scope of the invention.

What is claimed is:

1. An aerial amusement system comprising:

(a) a concentrically contoured base member having a top surface and a bottom surface on opposing sides thereof and a circularly contoured central opening for insert of an axle member therethrough, a ring shaped top annular groove concentrically formed about said axis of said central opening within said top surface, a plurality of projections extending in an arcuate and radial direction extending in an upward direction with respect to said top surface, each of said projections having a width dimension defined in the direction normal to said radially outward direction, said width dimension of each said projections decreasing toward a respective projection radial extremity, each said projection having a bead-like formation formed thereon at a respective outer radial extremity, said central opening extending through said base member substantially perpendicular to said top and bottom surfaces;

(b) a longitudinally extended swivel bar member having a top face and a bottom face on opposing sides thereof, said swivel bar having an inner end and an outer end defining opposing longitudinal extremities of said swivel bar, a circularly contoured axle opening adjacent said inner end formed by a passage extending therethrough, a counter weight mounted to said bottom face adjacent said outer end, said axle opening bounded by a tubular protrusion in alignment therewith, an outer wall of said tubular protrusion having a predetermined diameter;

(c) a disk-shaped scoreboard member having indicia formed thereon, said scoreboard having a center through hole for press fitting of said scoreboard member onto said tubular protrusion of said swivel bar member;

(d) a top cover member having a center opening for insert of said axle member, said top cover member having a convex lens formed thereon for viewing therethrough of said indicia of said scoreboard member:

(e) fastening means for concentrically capturing in constrained relation said base member, said swivel member, said scoreboard member, and said top cover member; and, (f) vacuum mounting means for adherence of said throwable amusement system to an external surface, said vacuum mounting means secured to said bottom surface of said base member.

2. The aerial amusement system of claim 1 wherein said vacuum mounting means includes:

(a) a circularly contoured rotary disk member having an upper surface and a lower surface on opposing sides thereof, an outer boundary defined by said circular contour, a plurality of circular cavities formed into said upper surface adjacent said outer boundary, and a plurality of protrusions formed onto said lower surface for the insertion respectively thereon of a plurality of vacuum mount members; and, (b) a plurality of steel balls to be respectively received in said cavities and captured therein by a ring-shaped bottom annular groove concentrically formed into said bottom surface of said base member when said upper surface of said vacuum mounting means is fastened to said bottom surface of said base member, said bottom annular groove having an inner annular surface for retaining said steel balls within said cavities by its abutment against said steel balls, said vacuum mount members fastened to said lower surface of said rotary disk member by respective insertion onto said protrusions.

3. The aerial amusement device of claim 1 wherein said vacuum mounting means includes a plurality of equally spaced apart protrusions formed onto said bottom surface of said base member for the insertion respectively thereon of a plurality of vacuum mount members and a plurality of said vacuum members fastened to said bottom surface of said base member by their respective insertion onto said protrusions.

* * * * *